US008544218B2

(12) United States Patent
Dellinger et al.

(10) Patent No.: US 8,544,218 B2
(45) Date of Patent: Oct. 1, 2013

(54) ACOUSTICALLY INSULATING PRODUCT

(75) Inventors: Allan Marcus Dellinger, Matthews, NC (US); Patrick H. Giles, Anoka, MN (US); Steven F. Nielsen, Charlotte, NC (US)

(73) Assignees: Dell SeVen, Inc., Matthews, NC (US); Maxxon Corporation, Hamel, MN (US); Southeast Nonwovens, Inc., Charlotte, NC (US)

( * ) Notice: Subject to any disclaimer, the term of this patent is extended or adjusted under 35 U.S.C. 154(b) by 588 days.

(21) Appl. No.: 12/409,996

(22) Filed: Mar. 24, 2009

(65) Prior Publication Data

US 2009/0242325 A1 Oct. 1, 2009

Related U.S. Application Data

(60) Provisional application No. 61/039,915, filed on Mar. 27, 2008, provisional application No. 61/039,918, filed on Mar. 27, 2008.

(51) Int. Cl.
*E04B 1/82* (2006.01)

(52) U.S. Cl.
USPC ..... 52/144; 52/406.2; 52/309.1; 52/404.1; 52/791.1; 181/284; 181/294; 442/36

(58) Field of Classification Search
USPC ..... 52/404.1, 406.2, 407.3, 403.1, 309.1, 52/309.8, 309.9, 309.13, 309.15, 144, 145, 52/791.1, 782.1; 188/284, 290, 294; 181/284, 181/290, 294; 442/35, 36, 37
See application file for complete search history.

(56) References Cited

U.S. PATENT DOCUMENTS

| | | | | |
|---|---|---|---|---|
| 3,667,175 | A * | 6/1972 | Bjorksten | 52/144 |
| 3,712,846 | A * | 1/1973 | Daniels et al. | 428/141 |
| 4,212,692 | A * | 7/1980 | Rasen et al. | 156/167 |
| 4,252,590 | A * | 2/1981 | Rasen et al. | 156/167 |
| RE31,599 | E * | 6/1984 | Rasen et al. | 156/167 |
| 4,966,799 | A * | 10/1990 | Lucca et al. | 428/95 |
| 5,364,681 | A * | 11/1994 | Pate et al. | 428/137 |
| 5,455,110 | A * | 10/1995 | Connor | 442/382 |
| 5,584,950 | A * | 12/1996 | Gaffigan | 156/71 |
| 5,585,161 | A * | 12/1996 | Difloe et al. | 428/109 |
| 5,681,408 | A * | 10/1997 | Pate et al. | 156/71 |
| 6,046,118 | A * | 4/2000 | Jones et al. | 442/57 |
| 6,077,613 | A * | 6/2000 | Gaffigan | 428/442 |
| 6,158,176 | A * | 12/2000 | Perdue | 52/144 |
| 7,096,630 | B1 | 8/2006 | Keene et al. | |
| 7,504,144 | B2 * | 3/2009 | Pott | 428/61 |
| 7,883,763 | B2 * | 2/2011 | Tinianov | 428/201 |
| 7,886,488 | B2 * | 2/2011 | Payne et al. | 52/144 |
| 7,908,810 | B2 * | 3/2011 | Payne et al. | 52/450 |
| 7,913,812 | B2 * | 3/2011 | Sanders | 181/290 |
| 7,921,965 | B1 * | 4/2011 | Surace | 181/290 |
| 2002/0160682 | A1 * | 10/2002 | Zeng et al. | 442/411 |
| 2003/0003826 | A1 * | 1/2003 | Rudisill et al. | 442/36 |
| 2003/0148693 | A1 * | 8/2003 | Erb et al. | 442/391 |
| 2003/0172600 | A1 * | 9/2003 | Choi | 52/144 |
| 2004/0229534 | A1 * | 11/2004 | Peruzzo | 442/36 |

(Continued)

*Primary Examiner* — Robert Canfield
*Assistant Examiner* — Matthew Gitlin
(74) *Attorney, Agent, or Firm* — Hammer & Associates, P.C.

(57) ABSTRACT

An acoustically insulating product for acoustically insulating a building structure includes a base entangled net material, and an acoustical nonwoven material. The acoustical nonwoven material is on at least one side of the base entangled net material. The acoustical nonwoven material has an increase in impact insulation class of 6 or greater.

14 Claims, 4 Drawing Sheets

(56) References Cited

U.S. PATENT DOCUMENTS

| | | | | |
|---|---|---|---|---|
| 2005/0059309 | A1* | 3/2005 | Tsotsis | 442/381 |
| 2005/0089678 | A1* | 4/2005 | Mead | 428/323 |
| 2005/0147810 | A1* | 7/2005 | Suzuki et al. | 428/339 |
| 2006/0123724 | A1* | 6/2006 | Pollack | 52/302.1 |
| 2006/0130416 | A1* | 6/2006 | Mohr et al. | 52/403.1 |
| 2006/0216471 | A1* | 9/2006 | Grah et al. | 428/137 |
| 2006/0225952 | A1* | 10/2006 | Takayasu et al. | 181/294 |
| 2006/0230699 | A1* | 10/2006 | Keene | 52/480 |
| 2006/0237130 | A1* | 10/2006 | Thompson | 156/273.3 |
| 2006/0289231 | A1* | 12/2006 | Priebe et al. | 181/290 |
| 2007/0000198 | A1* | 1/2007 | Payne et al. | 52/414 |
| 2007/0066176 | A1* | 3/2007 | Wenstrup et al. | 442/415 |
| 2007/0094950 | A1* | 5/2007 | Surace et al. | 52/144 |
| 2007/0125011 | A1* | 6/2007 | Weir et al. | 52/144 |
| 2007/0261365 | A1* | 11/2007 | Keene | 52/796.1 |
| 2007/0289238 | A1* | 12/2007 | Payne et al. | 52/408 |
| 2008/0121461 | A1* | 5/2008 | Gross et al. | 181/286 |
| 2008/0251187 | A1* | 10/2008 | Haque et al. | 156/148 |
| 2010/0066121 | A1* | 3/2010 | Gross | 296/146.5 |
| 2010/0077684 | A1* | 4/2010 | Socha | 52/403.1 |
| 2010/0229486 | A1* | 9/2010 | Keene | 52/403.1 |
| 2010/0282539 | A1* | 11/2010 | Cais et al. | 181/290 |
| 2011/0067348 | A1* | 3/2011 | Giles et al. | 52/741.1 |
| 2011/0271637 | A1* | 11/2011 | Wingfield | 52/745.05 |

* cited by examiner

ACOUSTICALLY INSULATING PRODUCT

RELATED APPLICATION

This application claims the benefit of U.S. Provisional application Ser. No. 61/039,915 filed Mar. 27, 2008 and U.S. Provisional application Ser. No. 61/039,918 filed Mar. 27, 2008.

FIELD OF INVENTION

The instant application relates to a material and method for providing acoustic insulation to a building structure.

BACKGROUND OF THE INVENTION

Soundproofing is any means of reducing the sound pressure with respect to a specified sound source and receptor. There are several basic approaches to reducing sound: increasing the distance between source and receiver, using noise barriers to block or absorb the energy of the sound waves, using damping structures such as sound baffles, or using active antinoise sound generators. Soundproofing affects sound in two different ways: noise reduction and noise absorption. Noise reduction simply blocks the passage of sound waves through the use of distance and intervening objects in the sound path. Noise absorption operates by transforming the sound wave. The instant application is directed toward the approach of soundproofing using the combination of distance and noise barriers to block or absorb the energy of the sound waves. We will refer to this soundproofing approach as providing acoustical insulation, i.e., acoustically insulating. Acoustic insulation is the process by which sonic vibrations are converted into heat over time and distance.

Most sound transfer from a room to the outside occurs through mechanical means. The vibration passes directly through the brick, woodwork and other solid structural elements. When sound waves meet with an element such as a wall, ceiling, floor or roof, the element acts as a sounding board where the vibration is amplified and heard in the second space. A mechanical transmission is much faster, more efficient and may be more readily amplified than an airborne transmission of the same initial strength. Thus, there is clearly a need for acoustically insulating the actual structural components of a building, i.e., the walls, ceilings, floors and roofs of a building structure.

Currently, acoustical insulation of a building structure is attempted in several ways. One way is to add a layer of material such as lead or neoprene. Lead and neoprene are commonly used as sound deadening layers in such areas as walls, floors and ceiling constructions where levels of air borne and mechanically produced sound are targeted for reduction or virtual elimination. However, lead and neoprene do not address the lower, most bothersome low frequency vibrations and can be very difficult to install because of their weight and softness. Furthermore, most lead and neoprene acoustical insulation materials are very costly. In addition, these two materials are either heavy (lead) or soft (neoprene), which may make installation of the materials difficult.

Less expensive options for acoustically insulating the walls, roofs, or ceilings of a building structure are limited to installing fiberglass or spraying foam insulation between walls or between a floor and ceiling. Fiberglass and foam achieve some acoustic insulation between the floors or rooms of the building structure, however, these current fiberglass and foam products do not provide ideal acoustical properties. As a result, the thickness of these fiberglass and foam materials has to be increased in order to achieve sufficient acoustical insulation of the building structure. This increase in thickness of the acoustically insulating material in turn forces an increase in the thickness of the walls, ceilings, floors, roofs, etc., which is an obvious disadvantage in the construction industry.

Many existing buildings and homes were built without any acoustical insulation between the floors, walls, roofs, ceilings, etc. Thus, there is a need to add acoustically insulating material to an existing building structure. However, if a structure is constructed without the installation of acoustical insulation, it is extremely difficult and costly to add the current heavy or thick materials at a later date. Accordingly, there is a need for a light weight, relatively thin material that can be added to existing building structures for providing acoustical insulation.

As a result of the aforementioned problems, a need exists for a relatively thin, sturdy and lightweight material which can be easily installed in between a new or existing building structure to provide acoustical insulation to the building structure. The instant invention is designed to provide an acoustically insulating product for a building structure that addresses all the problems mentioned above.

SUMMARY OF THE INVENTION

The instant invention includes an acoustically insulating product for acoustically insulating a building structure. The acoustically insulating product includes a base entangled net material, and an acoustical nonwoven material. The acoustical nonwoven material is on at least one side of the base entangled net material. The acoustical nonwoven material has an increase in impact insulation class of 6 or greater.

BRIEF DESCRIPTION OF THE DRAWINGS

For the purpose of illustrating the invention, there is shown in the drawings a form that is presently preferred; it being understood, however, that this invention is not limited to the precise arrangements and instrumentalities shown.

DETAILED DESCRIPTION OF THE INVENTION

Figure 1:
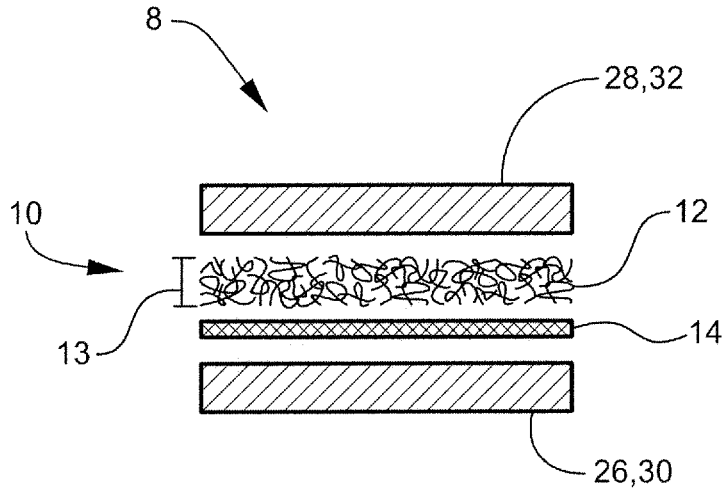
FIG. 1 is a cross-sectional view of one embodiment of a building structure with the acoustically insulating product installed according to the instant invention.

Referring to the drawings, wherein like numerals indicate like elements, there is shown in FIG. 1 an embodiment of a building structure 8 including an acoustically insulating product 10 installed according to the instant invention. Building structure 8 can be any building structure, including, but not limited to, a floor, a wall, a roof, a ceiling, etc. For ease and consistency of this application, we may refer to building structure 8 as a floor system; however, the invention is not so limited.

Figure 2:
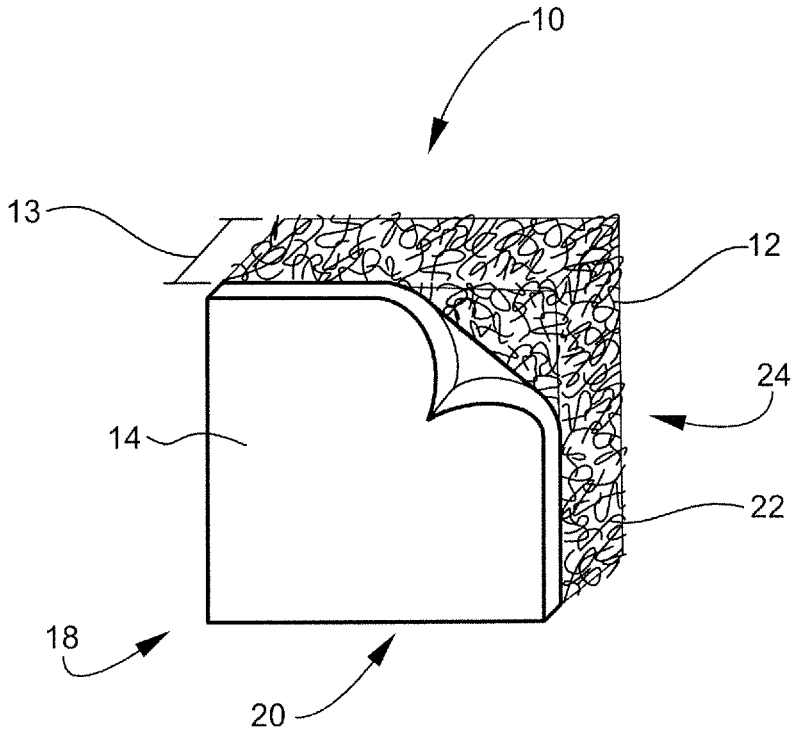
FIG. 2 is a perspective view of one embodiment of the acoustically insulating product with the acoustical nonwoven layer partially rolled back.

Acoustically insulating product 10 may be included in building structure 8. See FIGS. 1 and 3-6. Acoustically insulating product 10 may be for acoustically insulating any building structure, including, but not limited to, a floor, a wall, a roof, or a ceiling. Acoustically insulating product 10 may include any known materials in the art for providing acoustical insulation. In one embodiment, acoustically insulating product 10 may include a base entangled net material 12, and an acoustical nonwoven material 14. See FIG. 2. In one embodiment of acoustically insulating product 10, acoustical nonwoven material 14 may be provided on one side of base entangled net material 12. In another embodiment, acoustical nonwoven material 14 may be provided on both sides of base entangled net material 12. Acoustical nonwoven material 14 may be optionally attached or secured to one or both sides of base entangled net material 12. For example, acoustical nonwoven material 14 may be thermally bonded to one or both sides of base entangled net material 12. Acoustically insulating product 10 may be provided in any shape or size. Acoustically insulating product 10 may be provided in any thickness, including, but not limited to, being provided in a thickness of approximately 5/32 of an inch. Acoustically insulating product 10 may have any basis weight, including but not limited to, a basis weight of 526 g/m$^2$. Acoustically insulating product 10 may have any puncture strength, including, a Mullen Burst of greater than 200 psi. Acoustically insulating product 10 may have any air permeability, including, an air permeability of 150 cam. Acoustically insulating product 10 may have any strength, including, but not limited to, a MD tensile strength of 30 lb/in and a CD Tensile of 30 lb/in.

Base entangled net material 12 may be included in acoustically insulating product 10. See FIG. 2. Base entangled net material 12 may be for providing an air space within acoustically insulating product 10. Base entangled net material 12 may be any material for providing an air space within acoustically insulating product 10. Base entangled net material 12 may include a thickness 13 for determining the depth of the air space within acoustically insulating product 10. The air space created by base entangled net material 12 may provide additional acoustical insulation, the amount of which, may be dependent on thickness 13. Base entangled net material thickness 13 may be any thickness. In one embodiment, base entangled net material thickness 13 may be between 4 mm and 22 mm. In another embodiment, base entangled net material thickness 13 may be between 6 mm and 19 mm. Base entangled net material 12 may have any basis weight, including, but not limited to, an embodiment with a basis weight between 200 g/m$^2$ and 1100 g/m$^2$, an embodiment with a basis weight between 300 g/m$^2$ and 1000 g/m$^2$, and/or an embodiment with a basis weight between 400 g/m$^2$ and 900 g/m$^2$. Base entangled net material 12 may also have any compressive strength, including, but not limited to, a compressive load strength of greater than 30,000 psf as measured by ASTM 1621 modified and ASTM 4716 (failure defined as reaching yield point or no continued measurable flow under stated load). Base entangled net material 12 may be a randomly entangled net material or it may be a fixed entanglement net material. Base entangled net material 12 may be any shaped entangled net material, including, but not limited to, a saw tooth entangled net material, a pyramid shaped entangled net material, a cornrow shaped entangled net material, and any other known shapes of entangled net materials in the art. Suitable entangled net structures are available commercially from Colbond, Inc. of Enka, N.C.

Base entangled net material 12 may be made out of any material. In one embodiment, base entangled net material 12 may be made out of a polymeric material 22. In this embodiment, polymeric material 22 may be melt fused together where a plurality of bonding points 24 may be distributed within base entangled net material 12. See FIG. 2. Polymeric material 22 may be any polymeric material, including, but not limited to, polypropylene, nylon 6, nylon 6.6, polyester, and any combinations thereof.

Acoustical nonwoven material 14 may be included in acoustically insulating product 10. See FIG. 2. Acoustical nonwoven material 14 may be for providing acoustically insulating product 10 with an increase in impact insulation class. Acoustical nonwoven material 14 may be provided on at least one side of base entangled net material 12, meaning, acoustical nonwoven material 14 may be provided on one side or on both sides of base entangled net material 12. Acoustical nonwoven material 14 may be any material for providing acoustically insulating product 10 with an increase in impact insulation class. Acoustical nonwoven material 14 may be provided in any thickness, including, but not limited to, being provided in an embodiment with a thickness of less than 1/8 of an inch, and an embodiment with a thickness of less than 1/6 of an inch. Acoustical nonwoven material 14 may have any basis weight, including but not limited to, a basis weight of 175 g/m$^2$. Acoustical nonwoven material 14 may have any puncture strength, including, a Mullen Burst of greater than 200 psi. Acoustical nonwoven material 14 may have any air permeability, including, an air permeability of 150 cam. Acoustical nonwoven material 14 may have any strength, including, but not limited to, a MD tensile strength of 30 lb/in and a CD tensile strength of 30 lb/in. Acoustical nonwoven material 14 may provide acoustically insulating product 10 with an increase in impact insulation class. Impact insulation class, also referred to as IIC, is a single-number rating derived from measured values of normalized impact sound pressure levels in accordance with ASTM Test Method E 492-09. It provides an estimate of the impact sound insulating performance of a floor-ceiling assembly. In one embodiment, acoustical nonwoven material 14 may have an increase in impact insulation class of 6 or greater. In another embodiment, acoustical nonwoven material 14 may have an increase in impact insulation class of 10 or greater. In yet another embodiment, acoustical nonwoven material 14 may have an increase in impact insulation class of 15 or greater.

Acoustical nonwoven material 14 may be any type of nonwoven known in the art. For example, acoustical nonwoven material 14 may be a spunbonded nonwoven, a meltblown nonwoven, a wet-lay nonwoven, an air-lay nonwoven, a carded non-woven, and any combinations thereof. Acoustical nonwoven material 14 may include a mixture of fibers 18, and a mixture of chemicals 20.

Mixture of fibers 18 may be included in acoustical nonwoven material 14. Mixture of fibers 18 may include any mixture of fibers. In one embodiment, mixture of fibers 18 may include a bicomponent binder fiber, a PET fiber, a nylon fiber, an acrylic fiber, and any combinations thereof. In another embodiment, mixture of fibers 18 may include a hollow fiber, or a hollow filament fiber. The hollow filament fiber may be any hollow filament fiber. For example, the hollow filament fiber may be a completely hollow filament fiber (straw like) or it may be a hollow filament fiber with a sponge like cross-section. In one embodiment, mixture of fibers 18 may constitute approximately 75 percent by volume of acoustical nonwoven material 14. In this embodiment, mixture of fibers 18 may generally be comprised of 39.2 percent of the pie wedge bicomponent nylon/PET, 29.4 percent of the PET/coPET bicomponent binder fiber, 19.6 percent of the PET fiber being 1.5 dpf by 0.25 inches, 9.8 percent of the nylon fiber being 6.0 dpf by 1.0 inch, and 2.0 percent of the acrylic fiber being 0.8 dpf by 0.12 inches.

Mixture of chemicals 20 may be included in acoustical nonwoven material 14. Mixture of chemicals 20 may include any mixture of chemicals, including, but not limited to, a acrylic latex, a crosslinker, a fluro-carbon based water repellant, and combinations thereof. In one embodiment, mixture of chemicals 20 may constitute approximately 25 percent by volume of acoustical nonwoven material 14. In this embodiment, mixture of chemicals 20 may generally be comprised of 92 percent of the acrylic latex, 6.8 percent of the crosslinker, and 1.2 percent of the fluro-carbon based water repellant.

Acoustical nonwoven material 14 may be manufactured in any manner for providing a nonwoven material with an increase in impact insulation class. In one embodiment, acoustical nonwoven material 14 may be manufactured by the following steps: providing a vat of water; adding mixture of fibers 18 to the vat of water; agitating mixture of fibers 18 in the vat of water to create a fiber/water mixture; pumping the fiber/water mixture to a headbox; depositing the fiber/water mixture onto a moving wire screen (fourdrinier) to form a web; removing the water from the web; adding mixture of chemicals 20; passing the web through a dryer to remove excess water and cause the latex and PET/coPET bicomponent binder fiber to bond to the other fibers in the web; and collecting the nonwoven material on a continuous roll.

Acoustically insulating product 10 may be included in a building structure 8 to provide acoustical insulation to building structure 8. See FIGS. 1 and 3-6. Building structure 8 can be any building structure, including, but not limited to, a floor, a wall, a roof, a ceiling, etc. For ease and consistency of this application, we may refer to building structure 8 as a floor, however, the invention is not so limited. Building structure 8 may include an inner structure 26, an outer structure 28, and acoustically insulating product 10 installed between inner structure 26 and outer structure 28.

Inner structure 26 may be included in building structure 8. Inner structure 26 may be any inner, lower or base structure of a building structure. For example, when building structure 8 is a floor system, inner structure 26 may be a subflooring 30. See FIGS. 1 and 3-6. However, inner structure 26 may also be the inner structure of a wall, ceiling, roof, etc. As another example, when building structure 8 is a roof, inner structure 26 may be the inner sheathing of the roof (i.e., plywood).

Outer structure 28 may be included in building structure 8. Outer structure 28 may be any outer, upper or facial structure of a building structure. For example, when building structure 8 may be a floor, outer structure 28 may be a flooring 32. See FIGS. 1 and 3-6. In one embodiment, outer structure 28 may be any type of flooring 32, including, but not limited to, a hardwood flooring, a soft-wood flooring, a tile, a hardenable material, a carpet, a gypsum topping, a light-weight concrete, a cementitious self leveling material, a mortar bed, a thin-set, a concrete topping, and any combinations thereof. However, outer structure 28 may also be the outer structure of a wall, ceiling, roof, etc. As another example, when building structure 8 is a roof, outer structure 28 may be the outer sheathing of the roof (i.e., shingles).

Acoustically insulated building structure 8 may optionally include a crack suppression entangled net material 34. See FIGS. 4 and 5. Crack suppression entangled net material 34 may be for providing building structure 8, namely a floor system, with a crack suppression resistance, including, but not limited to, an entangled net material. Crack suppression entangled net material 34 may be any material for providing a crack suppression resistance. Crack suppression entangled net material 34 may include a thickness 35. Crack suppression entangled net material thickness 35 may be any thickness. In one embodiment, crack suppression entangled net material thickness 35 may be between 4 mm and 22 mm. In another embodiment, crack suppression entangled net material thickness 35 may be between 6 mm and 19 mm. Crack suppression entangled net material 34 may have any basis weight, including, but not limited to, an embodiment with a basis weight between 200 g/m$^2$ and 1100 g/m$^2$, an embodiment with a basis weight between 300 g/m$^2$ and 1000 g/m$^2$, and/or an embodiment with a basis weight between 400 g/m$^2$ and 900 g/m$^2$. Crack suppression entangled net material 34 may also have any compressive strength, including, but not limited to, a compressive load strength of greater than 30,000 psf as measured by ASTM 1621 modified and ASTM 4716 (failure defined as reaching yield point or no continued measurable flow under stated load). Crack suppression entangled net material 34 may be a randomly entangled net material or it may be a fixed entanglement net material. Crack suppression entangled net material 34 may be any shaped entangled net material, including, but not limited to, a saw tooth entangled net material, a pyramid shaped entangled net material, a cornrow shaped entangled net material, and any other shaped entangled net material known in the art. Suitable entangled net structures are available commercially from Colbond, Inc. of Enka, N.C. In one embodiment, crack suppression entangled net material 34 may be identical to base entangled net material 12. In another embodiment, crack suppression entangled net material 34 may be a different entangled net material from base entangled net material 12.

Crack suppression entangled net material 34 may provide any amount of crack suppression resistance to acoustically insulating product 10. This crack suppression resistance will prevent or greatly reduce cracking of the flooring system by reducing the horizontal shifting of flooring 32. For example, crack suppression entangled net material 34 may prevent or greatly reduce cracking in a gypsum topping, a light-weight concrete, a cementitious self leveling material, a mortar bed, a thin-set, and/or a concrete topping. Crack suppression entangled net material 34 may be oriented in any direction. For an optimal crack suppression resistance, crack suppression entangled net material 34 may be oriented at a ninety degree angle to base entangled net material 12. This ninety degree orientation may provide the greatest resistant to horizontal movement of flooring 32. For example, if the two entangled net materials are corn row type entangled net materials, in one of the entangled net materials, the cornrows would run in one horizontal direction, and in the other entangled net material the corn rows would run in the other horizontal direction, i.e., at a ninety degree angle. Crack suppression entangled net material 34 may also be for providing additional air space to acoustically insulating product 10 for additional acoustical insulation. Crack suppression entangled net material 34 may be anywhere between inner structure 26 and outer structure 28. In one embodiment, crack suppression entangled net material 34 may be between base entangled net material 12 and outer structure 28.

Acoustically insulated building structure 8 may also include a nonwoven fabric 40. Nonwoven fabric 40 may be for preventing debris or other materials from entering crack suppression entangled net material 34. Nonwoven fabric 40 may be attached to either or both sides of crack suppression entangled net material 34. For example, nonwoven fabric 40 may be thermally bonded to one or both sides of crack suppression entangled net material 34. Nonwoven fabric 40 may be any nonwoven fabric known in the art. In one embodiment, nonwoven fabric 40 may have an acoustical insulation property or an increase in impact insulation class. For example, nonwoven fabric 40 may be similar to acoustical nonwoven material 14. In another embodiment, nonwoven fabric 40 may provide no or minimal acoustical insulation properties.

Referring to FIG. 1, an embodiment of building structure 8 is shown with acoustically insulating product 10 positioned between inner structure 26 and outer structure 28. In this embodiment, acoustical non-woven material 14 is positioned adjacent to inner structure 26 and base entangled net material 12 is positioned adjacent outer structure 28. For example, if building structure 8 is a flooring system, the arrangement would be to provide subflooring 30, then installing acoustically insulating product 10 on top of subflooring 30 with acoustical nonwoven material 14 adjacent subflooring 30, and finally installing flooring 32 on top of base entangled net material 12. In this embodiment, acoustically insulating product 10 may be provided where acoustical nonwoven material 14 and base entangled net material 12 are bonded together to form a mat. Acoustically insulating product 10 may also be provided where the two materials are provided and installed separately.

Figure 3:
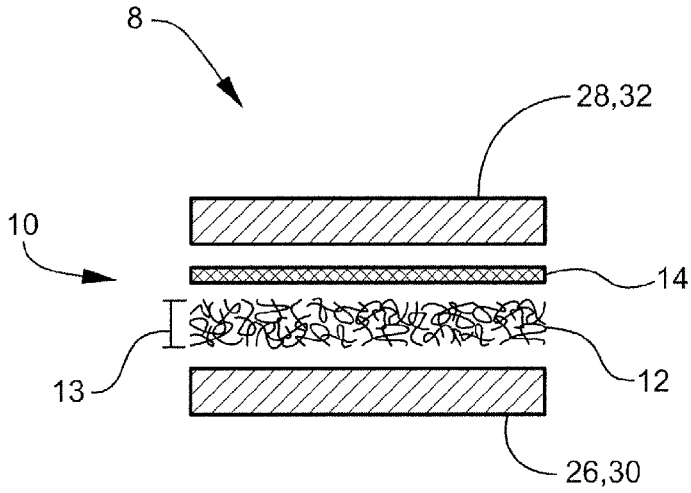
FIG. 3 is a cross-sectional view of another embodiment of a building structure with the acoustically insulating product installed according to the instant invention.

Referring to FIG. 3, another embodiment of building structure 8 is shown with acoustically insulating product 10 positioned between inner structure 26 and outer structure 28. In this embodiment, acoustical non-woven material 14 may be positioned adjacent to outer structure 28 and base entangled net material 12 may be positioned adjacent inner structure 26. For example, if building structure 8 is a flooring system, the arrangement might be to provide subflooring 30, then installing acoustically insulating product 10 on top of subflooring 30 with base entangled net material 12 adjacent subflooring 30, and finally installing flooring 32 on top of acoustical nonwoven material 14. In this embodiment, acoustically insulating product 10 may also be provided where acoustical nonwoven material 14 and base entangled net material 12 are bonded together to form a mat. Acoustically insulating product 10 may also be provided where the two materials are provided and installed separately.

Figure 4:
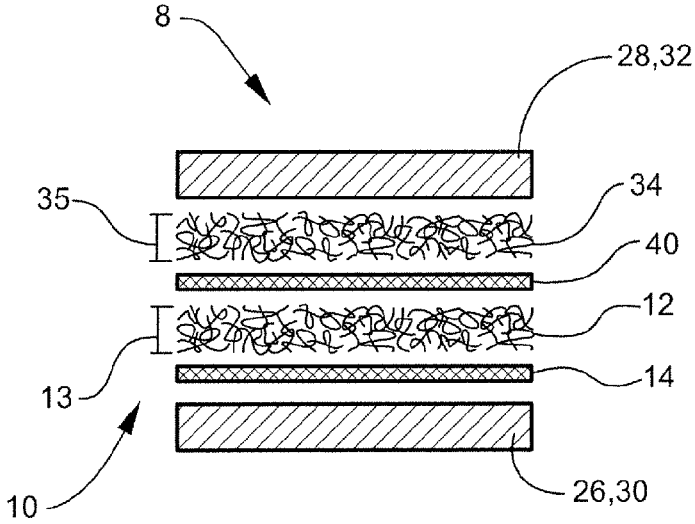
FIG. 4 is a cross-sectional view of another embodiment of a building structure with the acoustically insulating product installed according to the instant invention.

Referring to FIG. 4, another embodiment of building structure 8 is shown with acoustically insulating product 10 positioned between inner structure 26 and outer structure 28. In addition, crack suppression entangled net material 34 and nonwoven fabric 40 may be installed between acoustically insulating product 10 and outer structure 28. In this embodiment, acoustical non-woven material 14 may be positioned adjacent to inner structure 26, base entangled net material 12 may be positioned adjacent to nonwoven fabric 40, and crack suppression entangled net material 34 may be positioned between nonwoven fabric 40 and outer structure 28. For example, if building structure 8 is a flooring system, the arrangement may be to provide subflooring 30, then installing acoustically insulating product 10 on top of subflooring 30 with acoustical nonwoven material 14 adjacent subflooring 30, then installing nonwoven fabric 40 on top of base entangled net material 12, then installing crack suppression entangled net material 34 on top of nonwoven fabric 40, and finally installing flooring 32 on top of crack suppression entangled net material 34. In different embodiments of building structure 8, as shown in FIG. 4, acoustically insulating product 10 may be provided where acoustical nonwoven material 14 and base entangled net material 12 are bonded together to form a mat, or where the two materials are provided and installed separately. In additional different embodiments, nonwoven fabric 40 and crack suppression entangled net material 34 may be provided where the two materials are bonded together in a mat form, or where the two materials are provided and installed separately. In yet another embodiment, acoustical nonwoven material 14, base entangled net material 12, nonwoven fabric 40 and crack suppression entangled net material 34 may be provided where all materials may be bonded together in a sandwich or laminate type structure. In each of these embodiments, in order to create maximum crack suppression resistance, base entangled net material 12 may be oriented at a ninety degree angle to crack suppression entangled net material 34.

Figure 5:
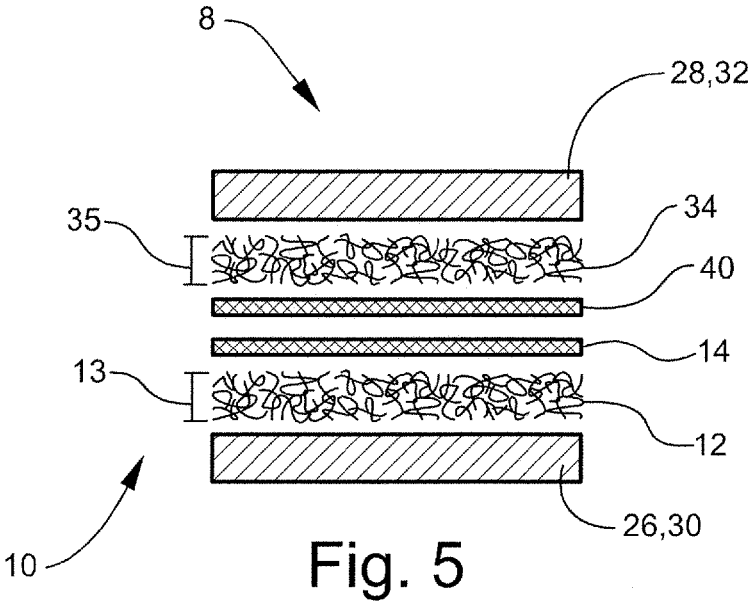
FIG. 5 is a cross-sectional view of another embodiment of a building structure with the acoustically insulating product installed according to the instant invention.

Referring to FIG. 5, another embodiment of building structure 8 is shown with acoustically insulating product 10 positioned between inner structure 26 and outer structure 28. In addition, crack suppression entangled net material 34 and nonwoven fabric 40 may be installed between acoustically insulating product 10 and outer structure 28. In this embodiment, base entangled net material 12 may be positioned adjacent to inner structure 26, acoustical nonwoven material 14 may be positioned adjacent to nonwoven fabric 40, and crack suppression entangled net material 34 may be positioned between nonwoven fabric 40 and outer structure 28. For example, if building structure 8 is a flooring system, the arrangement might be to provide subflooring 30, then installing acoustically insulating product 10 on top of subflooring 30 with base entangled net material 12 adjacent subflooring 30, then installing nonwoven fabric 40 on top of acoustical nonwoven material 14, then installing crack suppression entangled net material 34 on top of nonwoven fabric 40, and finally installing flooring 32 on top of crack suppression entangled net material 34. In different embodiments of building structure 8, as shown in FIG. 5, acoustically insulating product 10 may be provided where acoustical nonwoven material 14 and base entangled net material 12 are bonded together to form a mat, or where the two materials are provided and installed separately. In additional different embodiments, nonwoven fabric 40 and crack suppression entangled net material 34 may be provided where the two materials are bonded together in a mat form, or where the two materials are provided and installed separately. In each of these embodiments, in order to create maximum crack suppression resistance, base entangled net material 12 should be oriented at a ninety degree angle to crack suppression entangled net material 34.

Figure 6:
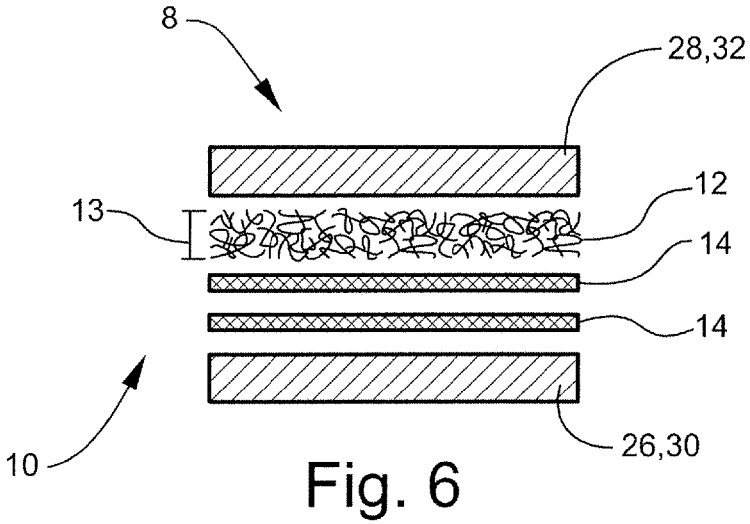
FIG. 6 is a cross-sectional view of another embodiment of a building structure with the acoustically insulating product installed according to the instant invention.

Referring to FIG. 6, another embodiment of building structure 8 is shown with acoustically insulating product 10 positioned between inner structure 26 and outer structure 28. In addition, another acoustical nonwoven material 14 may be provided anywhere between inner structure 26 and outer structure 28. This additional layer of acoustical nonwoven material 14 may be provided in any of the embodiments shown above and positioned anywhere between inner structure 26 and outer structure 28 in order to provide an additional increase in impact insulation class. In the embodiment shown in FIG. 6, the first acoustical non-woven material 14 may be positioned adjacent to inner structure 26, the second acoustical nonwoven material 14 may be positioned on top of the first, and base entangled net material 12 may be positioned adjacent outer structure 28. For example, if building structure 8 is a flooring system, the arrangement may be to provide subflooring 30, then installing a first layer of acoustical nonwoven material 14, then installing acoustically insulating product 10 on top of subflooring 30 with the second acoustical nonwoven material 14 adjacent the first acoustical nonwoven material 14, and finally installing flooring 32 on top of base entangled net material 12. In this embodiment, acoustically insulating product 10 may be provided where acoustical nonwoven material 14 and base entangled net material 12 are bonded together to form a mat. Acoustically insulating product 10 may also be provided where the two materials are provided and installed separately.

Figure 7:
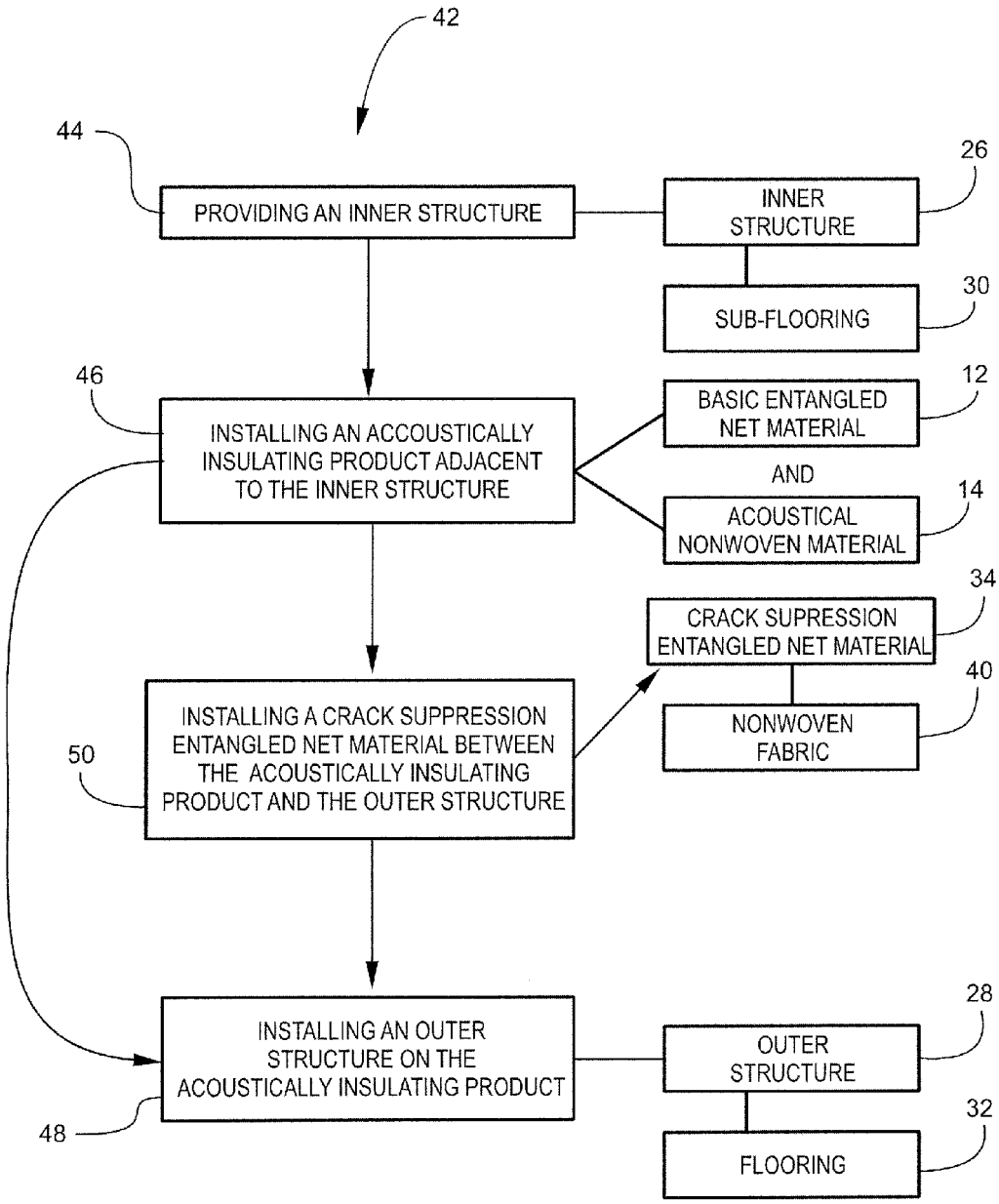
FIG. 7 is a diagram of one embodiment of the method of acoustically insulating a building structure according to the instant invention.

Referring to FIG. 7, a method 42 of acoustically insulating building structure 8 is shown. Method 42 may include any steps for acoustically insulating building structure 8. Method 42 may include the following steps: a step 44 of providing inner structure 26; a step 46 of installing acoustically insulating product 10 adjacent to inner structure 26; and a step 48 of installing outer structure 28 on acoustically insulating product 10. In one embodiment, a step 50 of installing crack suppression entangled net material 34 between acoustically insulating product 10 and outer structure 28 may be included in method 42.

Step 44 of providing inner structure 26 may be included in method 42 of acoustically insulating building structure 8. See FIG. 7. Step 44 may include any steps for providing inner structure 26. Step 44 may include providing any type of inner structure 26. In one embodiment, step 44 may include providing subflooring 30. In other embodiments, step 44 may include providing any inner structure for a floor, wall, roof, ceiling, etc.

Step 46 of installing acoustically insulating product 10 adjacent to inner structure 26 may be included in method 42 of acoustically insulating building structure 8. See FIG. 7. Step 46 may include any steps for installing acoustically insulating product 10 adjacent to inner structure 26. In one embodiment, step 46 may include installing the acoustical nonwoven material side of acoustically insulating product 10 adjacent to inner structure 26 (see FIGS. 1, 4 and 6). In another embodiment, step 46 may include installing the base entangled net material side of acoustically insulating product 10 adjacent to inner structure 26 (see FIGS. 3 and 5). Step 46 may include installing acoustically insulating product 10 with base entangled net material 12 and acoustical nonwoven material 14 attached together as a mat. Alternatively, step 46 may include installing acoustically insulating product 10 with base entangled net material 12 and acoustical nonwoven material 14 not attached, where each material is installed separately.

Step 48 of installing outer structure 28 on acoustically insulating product 10 may be included in method 42 of acoustically insulating building structure 8. See FIG. 7. Step 48 may include any steps for installing outer structure 28. Step 48 may include installing any type of outer structure 28. In one embodiment, step 48 may include installing flooring 32, including, but not limited to, installing a hardwood flooring, a soft-wood flooring, a tile, a hardenable material, a carpet, a gypsum topping, a light-weight concrete, a cementitious self leveling material, a mortar bed, a thin-set, a concrete topping, and any combinations thereof. In other embodiments, step 48 may include providing any outer structure for a floor, wall, roof, ceiling, etc.

Step 50 of installing crack suppression entangled net material 34 between acoustically insulating product 10 and outer structure 28 may optionally be included in method 42 of acoustically insulating building structure 8. See FIG. 7. Step 50 may include any steps for installing crack suppression entangled net material 34 between acoustically insulating product 10 and outer structure 28. In one embodiment, step 50 may include installing crack suppression entangled net material and nonwoven fabric 40. These materials may be installed as a mat or separately. In one embodiment, nonwoven fabric 40 may be installed adjacent to acoustically insulating product 10. In another embodiment, nonwoven fabric 40 may be installed adjacent to outer structure 28.

The instant invention may be embodied in other forms without departing from the spirit and the essential attributes thereof, and, accordingly, reference should be made to the appended claims, rather than to the foregoing specification, as indicated in the scope of the invention.

We claim:

1. An acoustically insulating product for acoustically insulating a building structure comprising:

a base entangled net material comprising a polymeric material being melt fused together where a plurality of bonding points being distributed within said base entangled net material;

said base entangled net material having a thickness between 4 mm and 22 mm, and a compressive load strength of greater than 30,000 psf as measured by ASTM 1621 modified and ASTM 4716; and an acoustical nonwoven material on at least one side of said base entangled net material;

said acoustical nonwoven material having an increase in impact insulation class of 6 or greater.

2. The acoustically insulating product for acoustically insulating a building structure of claim 1 where said acoustical nonwoven material having an increase in impact insulation class of 10 or greater.

3. The acoustically insulating product for acoustically insulating a building structure of claim 1 where said acoustical nonwoven material having an increase in impact insulation class of 15 or greater.

4. The acoustically insulating product for acoustically insulating a building structure of claim 1 where said acoustical nonwoven material comprising:

a mixture of fibers, and a mixture of chemicals.

5. The acoustically insulating product for acoustically insulating a building structure of claim 4 where said mixture of fibers being selected from the group consisting of: a bicomponent fiber; a PET fiber; a nylon fiber; an acrylic fiber; and any combinations thereof.

6. The acoustically insulating product for acoustically insulating a building structure of claim 4 where said mixture of fibers including a hollow fiber.

7. The acoustically insulating product for acoustically insulating a building structure of claim 6 where said hollow fiber being a hollow filament fiber with a sponge like cross-section.

8. The acoustically insulating product for acoustically insulating a building structure of claim 4 where said mixture of chemicals being selected from the group consisting of: an acrylic latex; a crosslinker; a fluro-carbon based water repellant; and combinations thereof.

9. An acoustically insulated building structure comprising:

an inner structure;

an outer structure; and an acoustically insulating product between said inner structure and said outer structure comprising:

a base entangled net material comprising a polymeric material being melt fused together where a plurality of bonding points being distributed within said base entangled net material;

said base entangled net material having a thickness between 4 mm and 22 mm, and a compressive load strength of greater than 30,000 psf as measured by ASTM 1621 modified and ASTM 4716; and an acoustical nonwoven material on at least one side of said base entangled net material;

said acoustical nonwoven material having an increase in impact insulation class of 6 or greater.

10. The acoustically insulated building structure of claim 9 where said inner structure being a subflooring and said outer structure being a flooring.

11. The acoustically insulated building structure of claim 10 where said flooring being selected from the group consisting of: a hardwood flooring; a soft-wood flooring; a tile; a hardenable material; a carpet; a gypsum topping; a lightweight concrete; a cementitious self leveling material; a mortar bed; a thin-set; a concrete topping; and combinations thereof.

12. The acoustically insulated building structure of claim 9 further comprising a crack suppression entangled net material being between said base entangled net material and said outer structure.

13. The acoustically insulated building structure of claim 12 where said crack suppression entangled net material being oriented at a ninety degree angle to said base entangled net material.

14. The acoustically insulated building structure of claim 9 where said acoustical nonwoven material comprising a mixture of fibers including a hollow fiber.

* * * * *